US005607508A

United States Patent [19]

Westphal

[11] Patent Number: 5,607,508

[45] Date of Patent: Mar. 4, 1997

[54] APPARATUS FOR SELECTIVELY COATING CORRUGATED SHEET MATERIAL

[76] Inventor: Scott K. Westphal, 67 Blackburn Rd., Basking Ridge, N.J. 07920

[21] Appl. No.: 486,558

[22] Filed: Jun. 7, 1995

[51] Int. Cl.[6] ..... B05C 17/04

[52] U.S. Cl. ..... 118/213; 118/301; 427/282; 427/421; 427/428

[58] Field of Search ..... 118/211, 213, 118/300, 301, 629, DIG. 15; 427/282, 421, 424, 428

[56] References Cited

U.S. PATENT DOCUMENTS

| | | | |
|---|---|---|---|
| 4,055,688 | 10/1977 | Caratsch | 118/211 |
| 4,546,011 | 10/1985 | Wolfrum | 118/211 |
| 5,360,481 | 11/1994 | Ludwig | 118/213 |

*Primary Examiner*—Laura Edwards
*Attorney, Agent, or Firm*—Kenyon & Kenyon

[57] ABSTRACT

An apparatus and method for applying material to the crests or troughs of corrugated sheet material or selected portions of substantially flat sheet material. A first roller is provided with a plurality of circumferentially-undulating flutes disposed about it peripheral surface. The flutes define first roller crests and first roller troughs. A second roller is provided with a plurality of circumferentially-undulating flutes disposed about its peripheral surface. The flutes define second roller crests and second roller troughs. The first roller and second roller are synchronized so that as the rollers rotate the crests of one roller nest in the troughs of the other roller. The crests or troughs of the first roller are provided with one or more nozzles which apply the desired quantity of coating material to the corrugated sheet material crests or troughs as the first and second roller crests and troughs nest.

1 Claim, 10 Drawing Sheets

APPARATUS FOR SELECTIVELY COATING CORRUGATED SHEET MATERIAL

BACKGROUND OF THE INVENTION

This invention relates generally to an apparatus and process for depositing thin films of coating material onto a substrate and more particularly for selectively applying controlled amounts of coating material in registration with portions of corrugated sheet material, substantially flat sheet material, or formed sheet material.

Thin films have an enormously, varying range of industrial applications. For example, thin films of gold, silver and chromium are used for decorative purposes, thin films of aluminum and nickel-boron have been used for corrosion protection, and thin films of magnesium fluoride, aluminum oxide and silicon oxide have all been used as non-reflective coatings for optical lenses.

Kirk-Othmer's "Encyclopedia of Chemical Technology", 3rd edition (1980) Vol. 10, pages 247 to 283 describes the following types of process for depositing thin films:

A. Deposition of Films from Solution
  1. Electrolytic deposition-cathodic and anodic films.
  2. Chromate conversion coatings.
  3. Electroless plating.
  4. Polymeric coatings.

B. Vacuum Deposition of Films
  1. Evaporation of inorganic materials.
  2. Evaporative coating with polymers.
  3. Vapour-phase polymerization.
  4. Sputtering.
  5. R-f sputtering of polymers.
  6. Ultra-violet irradiation, photopolymerization.

C. Deposition of Films in Gaseous Discharge

D. Deposition of Films at Atmospheric Pressure
  1. Metallo-organic deposition.
  2. Electron-beam polymerization.
  3. Gamma irradiation.
  4. UV solid polymerization.

The present invention provides a method of depositing films which falls into none of the above-mentioned categories. The method and apparatus has application to a vast range of corrugated sheet material, substantially flat sheet material, or formed sheet material and coating materials.

Precious and semi-precious metals such as chromium, palladium, platinum, silver, and gold are often applied to corrugated surfaces, e.g., catalytic converters. It is desirable to apply these metals at the precise location in the minimum amount necessary so as to increase the efficiency of the coated apparatus and permit the welding, brazing, or bonding of the non-coated areas, while minimizing the amount of precious metals utilized.

Conventional methods apply coatings to individual sheets of substantially flat material, or on coils of substantially flat sheet material, in a continuous film or non-registration patterns. One shortcoming of these prior art systems is that they are labor intensive. Another shortcoming is that they are slow. Yet another shortcoming is that it is difficult to control the amount and location of material applied which may result in uneven application and waste.

SUMMARY AND OBJECTS OF THE INVENTION

It is an object of this invention to provide an apparatus and method for applying controlled amounts of material to the crests of corrugated sheet material, substantially flat sheet material, or formed sheet material.

It is another object of this invention to provide an apparatus and method for applying controlled amounts of material to the troughs of corrugated sheet material, substantially flat sheet material, or formed sheet material.

It is still another object of this invention to provide an apparatus and method of applying controlled amounts of material to discrete portions of corrugated sheet material, substantially flat sheet material, or formed sheet material.

Additional advantages and features of the present invention will become apparent from the subsequent description and the appended claims taken in conjunction with the accompanying drawings.

DETAILED DESCRIPTION OF THE INVENTION

Figure 1:
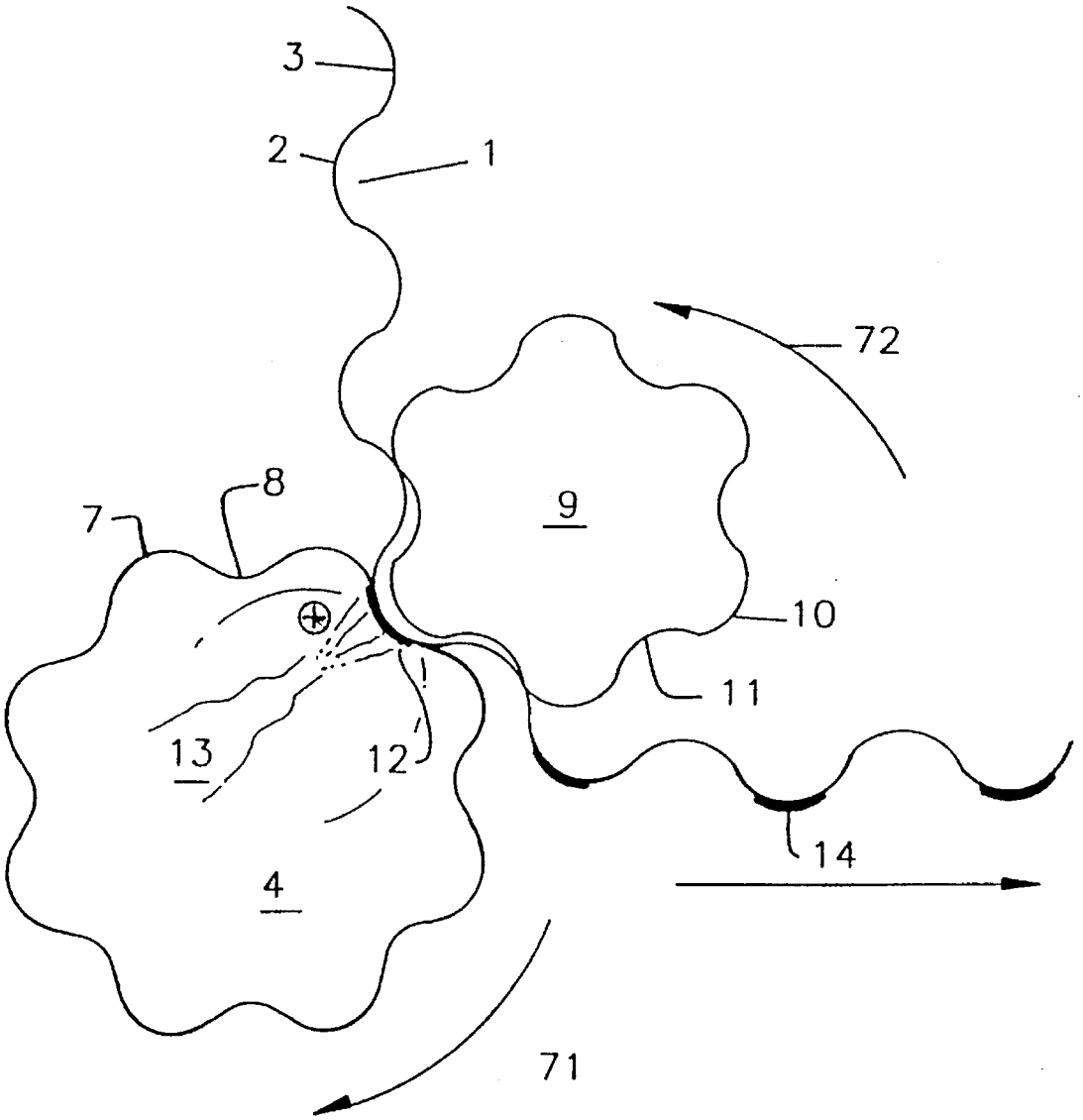
FIG. 1 shows an apparatus constructed in accordance with the invention for applying material to the crests of corrugated sheet material.
Figure 2:
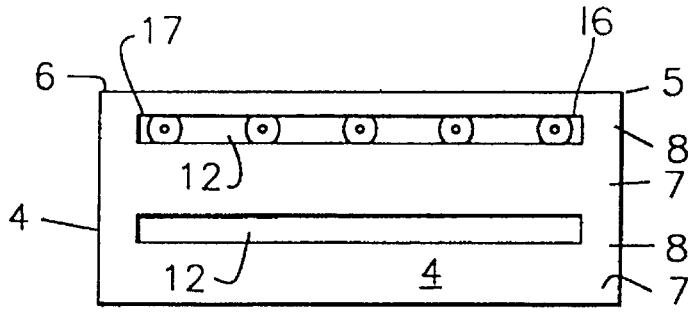
FIG. 2 is a top view of the first roller shown in FIG. 1.
Figure 3:
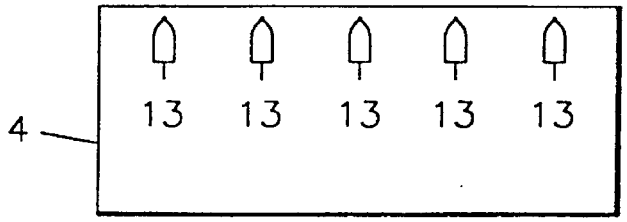
FIG. 3 is a cross-sectional side view of the first roller shown in FIG. 2.

FIG. 1 shows an apparatus constructed in accordance with the invention for applying material to the crests of corrugated sheet material. FIG. 1 shows a corrugated sheet material 1 defining sheet material crests 2 and sheet material troughs 3. First roller 4 has a first end 5 and a second end 6 and is provided with a plurality of circumferentially-undulating flutes disposed about it peripheral surface defining first roller crests 7 and first roller troughs 8. Second roller 9 is provided with a plurality of circumferentially-undulating flutes disposed about its peripheral surface defining second roller crests 10 and second roller troughs 11. As shown in FIG. 1, the first roller 4 and second roller 9 are synchronized so that as the rollers 4 and 9 rotate in the direction shown by the arrows 71 and 72, the crests 7 and 10 of one roller nest in the troughs 8 and 11 of the other roller. At the stage of rotation shown in FIG. 1, second roller crest 10 nests in first roller trough 8. Sufficient space is provided between the first roller 4 and the second roller 9 so that the corrugated sheet material 1 is gripped by and can pass between the first roller 4 and second roller 9.

As shown in FIGS. 1 to 4, trough 8 on roller 4 is provided with one or more first roller apertures 12 aligned with one or more internally disposed pressurized nozzles 13 which apply the desired quantity of coating material 14 through first roller aperture 12 to the corrugated sheet material crests 2 as they nest in first roller trough 8. First roller trough 8 is provided with a longitudinal aperture 12 having a first end 16 and a second end 17 disposed between first end 5 and second end 6 of first roller 4. One or more pressurized nozzles 13 are disposed in a fixed position within first roller 4 to apply the desired coating 14 through each aperture 12 as each aperture 12 of first roller 4 rotates into alignment with the nozzle 13. The size of the apertures 12 may be varied as specific applications dictate so as to vary the mask provided for the nozzle 13. The nozzle 13 may also be provided with variable control heads for additional control of the amount of material 14 deposited.

Figure 4:
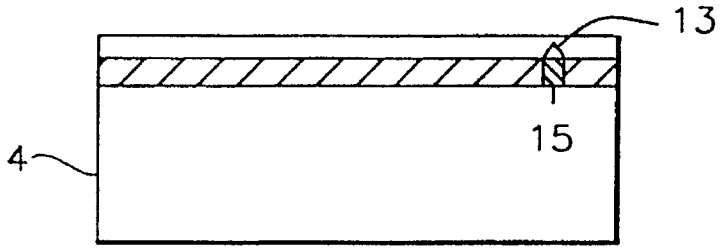
FIG. 4 shows an alternative embodiment of the first roller shown in FIG. 1.

In an alternative embodiment, as shown in FIG. 4, a single nozzle 13 may be provided which is adapted for movement from the first end 16 to the second end 17 of longitudinal aperture 12 via nozzle moving means 15. Thus, in this embodiment, the nozzle 13 can apply a uniform coating of material 14 along the entire corrugated sheet material crest 2 or at discrete portions of the sheet material crest 2 as the nozzle 13 reciprocates between the first end 16 and the second end 17 of longitudinal aperture 12.

Figure 4A:
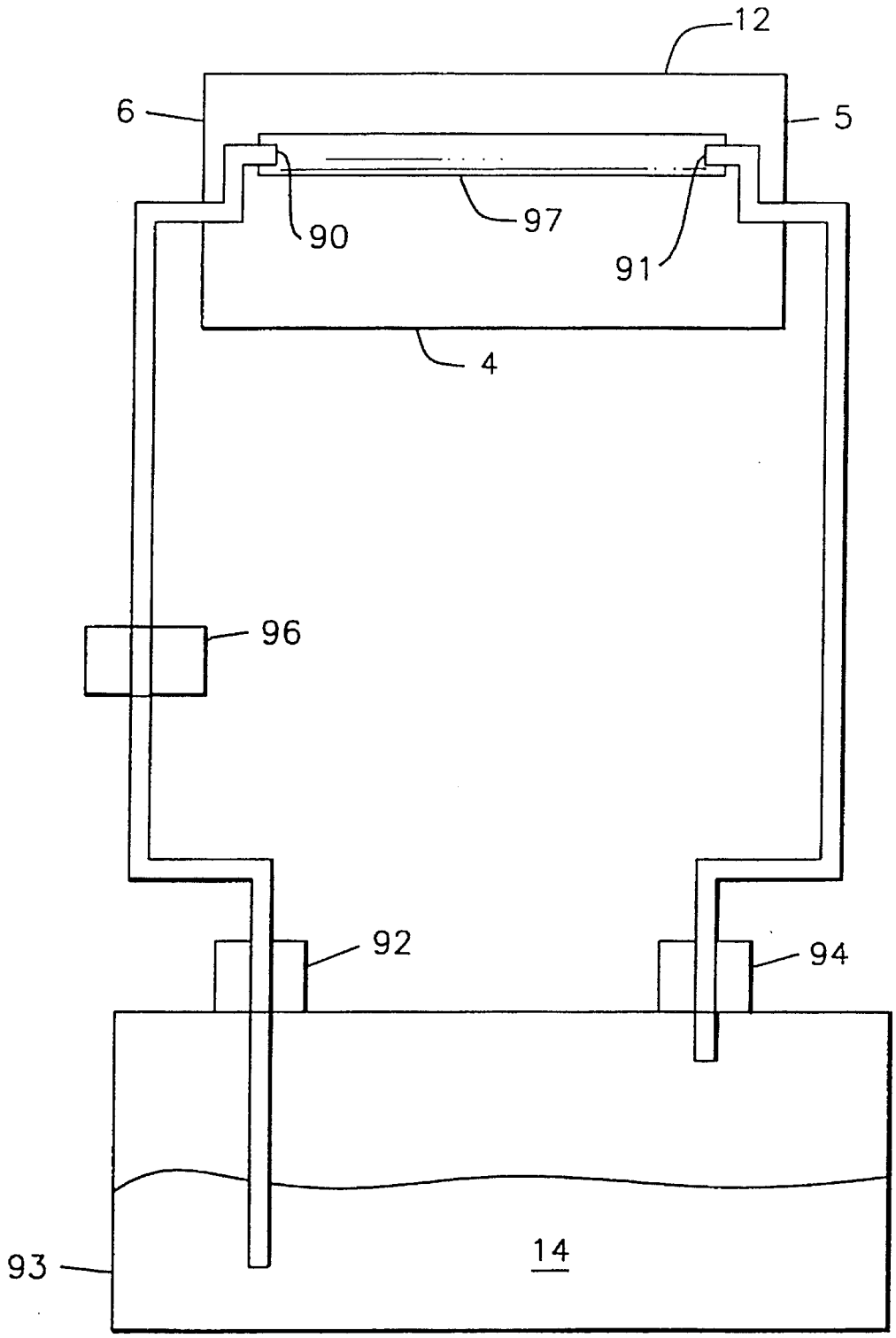
FIG. 4A shows an alternative embodiment of the first roller shown in FIG. 1.
Figure 4B:
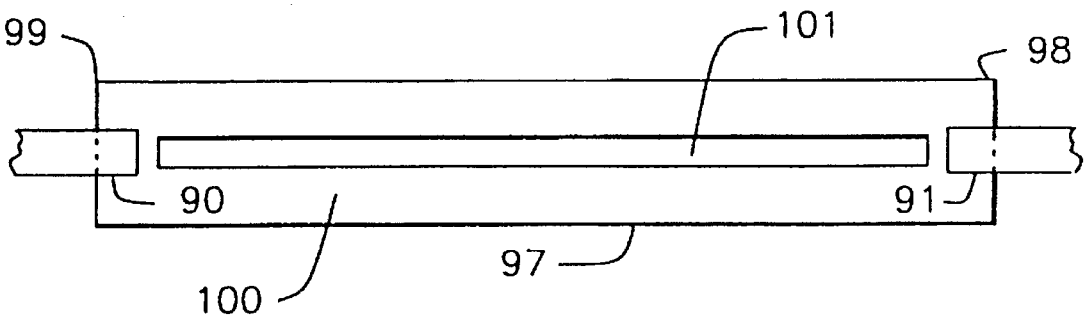
FIG. 4B is a top view of the venturi tube shown in FIG. 4A.
Figure 4C:
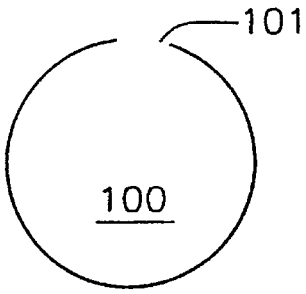
FIG. 4C is an end view of the venturi tube shown in FIG. 4B.

In an alternative embodiment, as shown in FIG. 4A, a pressure nozzle 90 is disposed at second end 6 of first roller 4 and a vacuum return tube 91 is disposed at the first end 5 of first roller 4. A venturi tube 97 having a first end 98 and a second end 99 is disposed between pressure nozzle 90 and vacuum return 91. Vacuum return tube 91 is in fluid communication with first end 98 and pressure nozzle 90 is in fluid communication with second end 99. FIG. 4B is a top view of the venturi tube 97 and FIG. 4C is an end view of the venturi tube 97. As shown in FIGS. 4B and 4C, the venturi tube 97 is provided with a longitudinal bore 100 communicating with first end 98 and second end 99. The venturi tube 97 is also provided with a longitudinal aperture 101 which allows the coating material 14 to leave the longitudinal bore 100 of the venturi tube 97 and pass through the roller aperture 12 to coat the material to be coated. When the apparatus is activated, pumping means 92 pumps a powdered or liquid coating material 14 from hopper 93. As the material 14 is introduced into the second end 98 of venturi tube 97, vacuum means 94 is activated to help pull the material 14 from the second end 99 to the first end 98 of the venturi tube 97. The vacuum means 94 also returns excess material 14 to the hopper 93 where it is recycled through the system. As the material 14 passes from the second end 99 to the first end 98 of the venturi tube 97 some of the material 14 passes through roller aperture 12 and adheres to the surface to be coated. In an especially preferred embodiment, the powdered or liquid material 14 is electrically charged prior to deposition via charging means 96.

Figure 5:
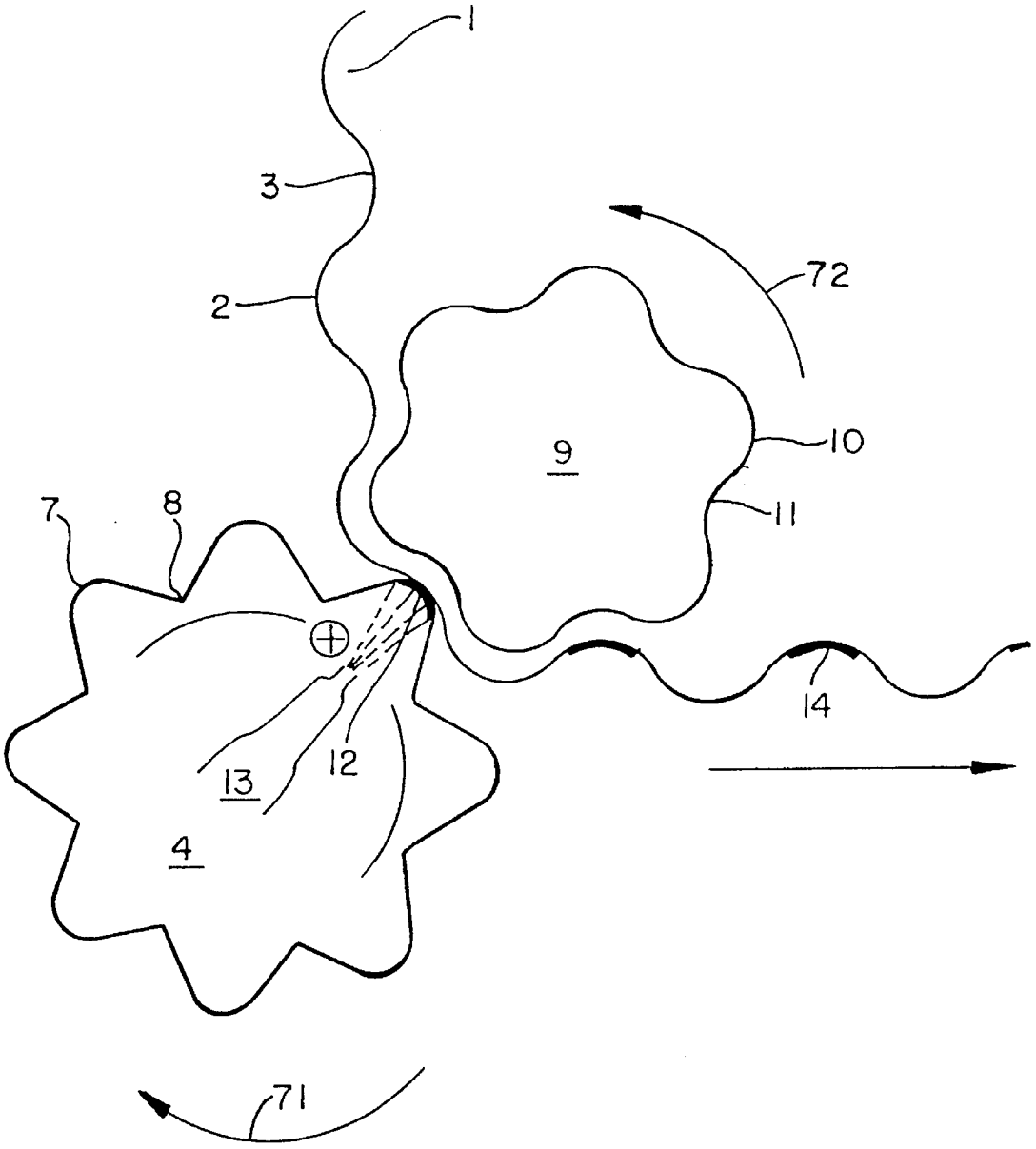
FIG. 5 shows an apparatus constructed in accordance with the invention for applying material to the troughs of corrugated sheet material.
Figure 6:
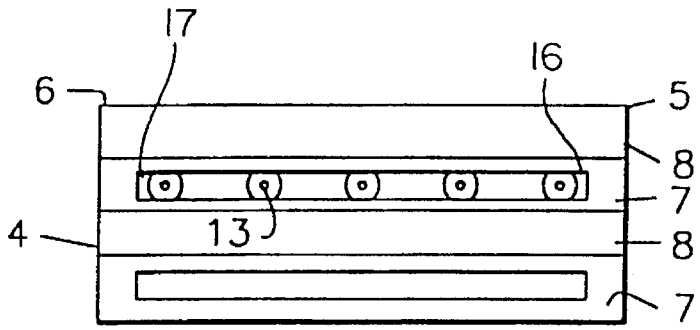
FIG. 6 is a top view of the first roller shown in FIG. 5.
Figure 7:
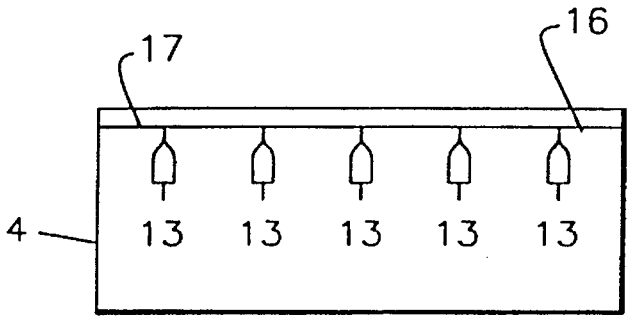
FIG. 7 is a cross-sectional view of the first roller shown in FIG. 6.

FIG. 5 shows an apparatus constructed in accordance with the invention for applying material to the troughs of corrugated sheet material. FIG. 5 shows a corrugated sheet material 1 defining sheet material crests 2 and sheet material troughs 3. First roller 4 has a first end 5 and a second end 6 and is provided with a plurality of circumferentially-undulating flutes disposed about it peripheral surface defining first roller crests 7 and first roller troughs 8. Second roller 9 is provided with a plurality of circumferentially-undulating flutes disposed about its peripheral surface defining second roller crests 10 and second roller troughs 11. As shown in FIG. 5, the first roller 4 and second roller 9 are aligned so that as the rollers 4 and 9 rotate in the direction shown by the arrows 71 and 72, the crests 7 and 10 of one roller nest in the troughs 8 and 11 of the other roller. At the stage of rotation shown in FIG. 5, first roller crest 7 nests in second roller trough 11. Sufficient space is provided between the first roller 4 and the second roller 9 so that the corrugated sheet material 1 is gripped by and can pass between the first roller 4 and second roller 9.

As shown in FIGS. 5 to 8, crest 7 on roller 4 is provided with one or more first roller apertures 12 aligned with one or more internally disposed nozzles 13 which apply the desired quantity of coating material 14 through first roller aperture 12 to the corrugated sheet material troughs 11 when first roller crest 7 nests in second roller trough 11. First roller crest 7 is provided with a longitudinal aperture 12 having a first end 16 and a second end 17 disposed between first end 5 and second end 6 of first roller 4. One or more nozzles 13 are disposed in a fixed position within first roller 4 to apply the desired coating 14 through each aperture 12 as each aperture 12 of first roller 4 rotates into alignment with the nozzle 13. The size of the apertures 12 may be varied as specific applications dictate so as to vary the mask provided for the nozzle 13. The nozzle 13 may also be provided with variable control heads for additional control of the amount of material 14 deposited.

Figure 8:
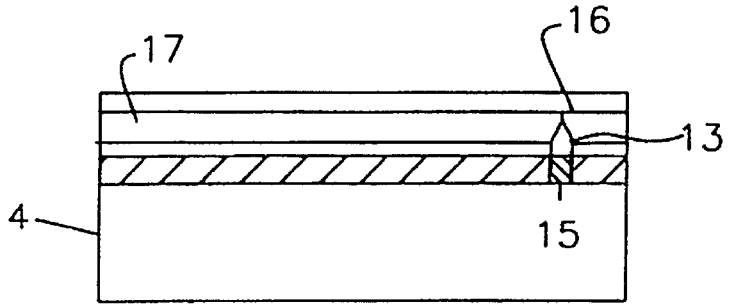
FIG. 8 shows an alternative embodiment of the first roller shown in FIG. 5.

In an alternative embodiment, as shown in FIG. 8, a single nozzle 13 may be provided which is adapted for movement from the first end 16 to the second end 17 of longitudinal aperture 12 via nozzle moving means 15. Thus, in this embodiment, the nozzle 13 can apply a uniform coating of material 14 along the entire corrugated sheet material trough 11 or at discrete portions of the sheet material trough 11 as the nozzle 13 reciprocates between the first end 16 and the second end 17 of longitudinal aperture 12.

Figure 8A:
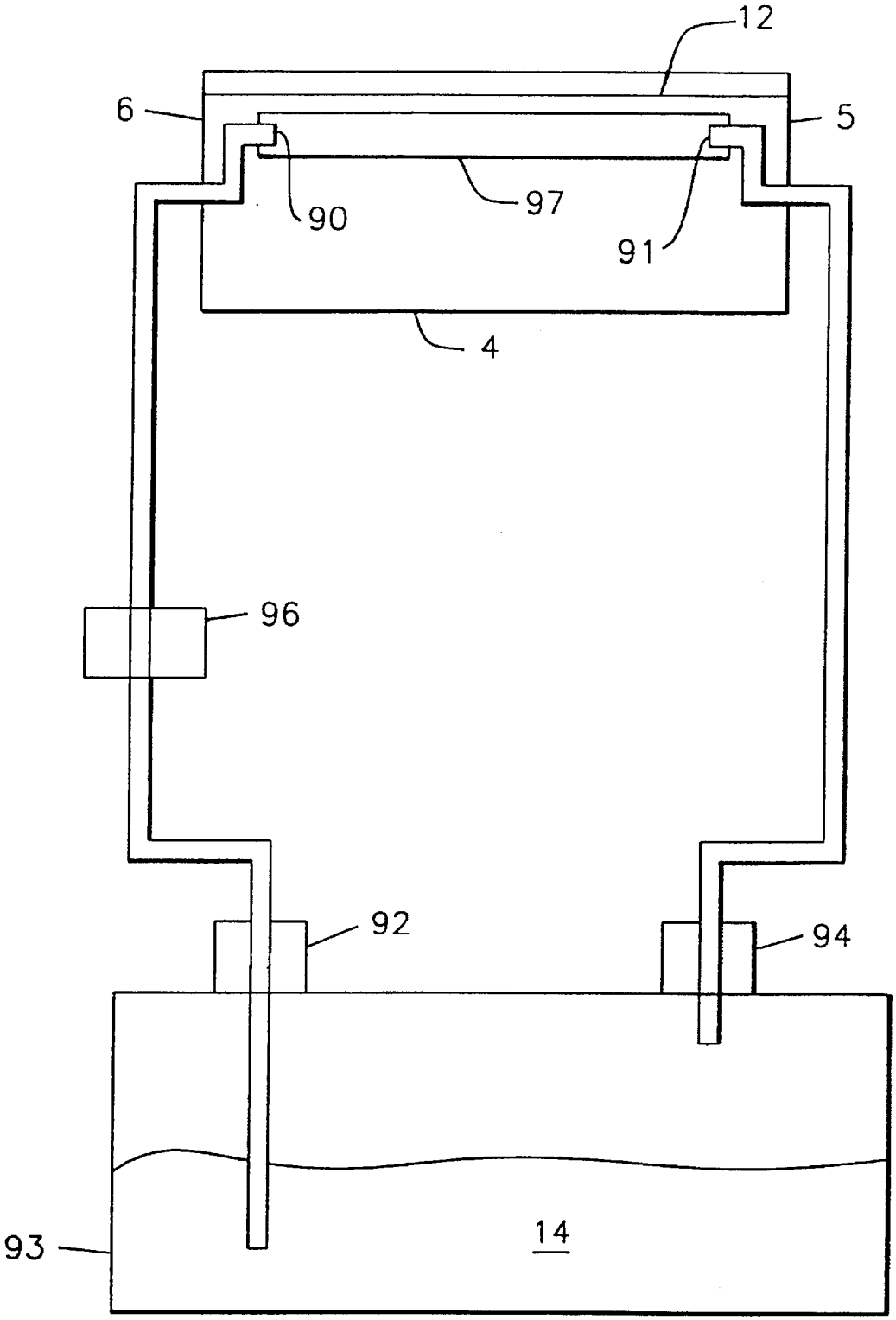
FIG. 8A shows an alternative embodiment of the first roller shown in FIG. 5.
Figure 8B:
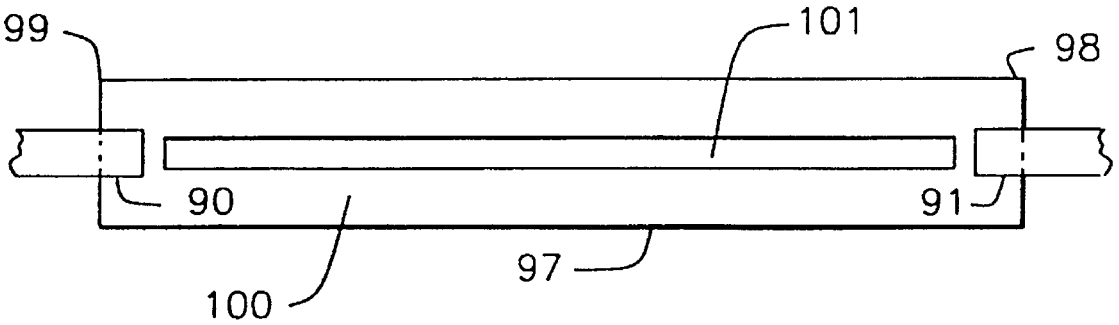
FIG. 8B is a top view of the venturi tube shown in FIG. 8A.
Figure 8C:
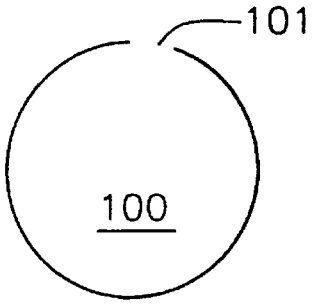
FIG. 8C is an end view of the venturi tube shown in FIG. 8B.

In an alternative embodiment, as shown in FIG. 8A, a nozzle 90 is disposed at second end 6 of first roller 4 and a vacuum return tube 91 is disposed at the first end 5 of first roller 4. A venturi tube 97 having a first end 98 and a second end 99 is disposed between pressure nozzle 90 and vacuum return 91. Vacuum return tube 91 is in fluid communication with first end 98 and pressure nozzle 90 is in fluid communication with second end 99. FIG. 8B is a top view of the venturi tube 97 and FIG. 8C is an end view of the venturi tube 97. As shown in FIGS. 8B and 8C, the venturi tube 97 is provided with a longitudinal bore 100 communicating with first end 98 and second end 99. The venturi tube 97 is also provided with a longitudinal aperture 101 which allows the coating material 14 to leave the longitudinal bore 100 of the venturi tube 97 and pass through the roller aperture 12 to coat the material to be coated. When the apparatus is activated, pumping means 92 pumps a powdered coating material 14 from hopper 93. As the material 14 is introduced into the second end 6 of first roller 4, vacuum means 94 is activated to draw the material 14 from the second end 6 to the first end 5 of first roller 4. The vacuum means 94 also returns excess material 14 to the hopper 93 where it is recycled through the system. As the material 14 moves from the second end 6 to the first end 5 of first roller 4 some of the material 14 passes through aperture 12 and adheres to the surface to be coated. In an especially preferred embodiment, the powdered material 14 is electrically charged prior to deposition via charging means 96.

Figure 9:
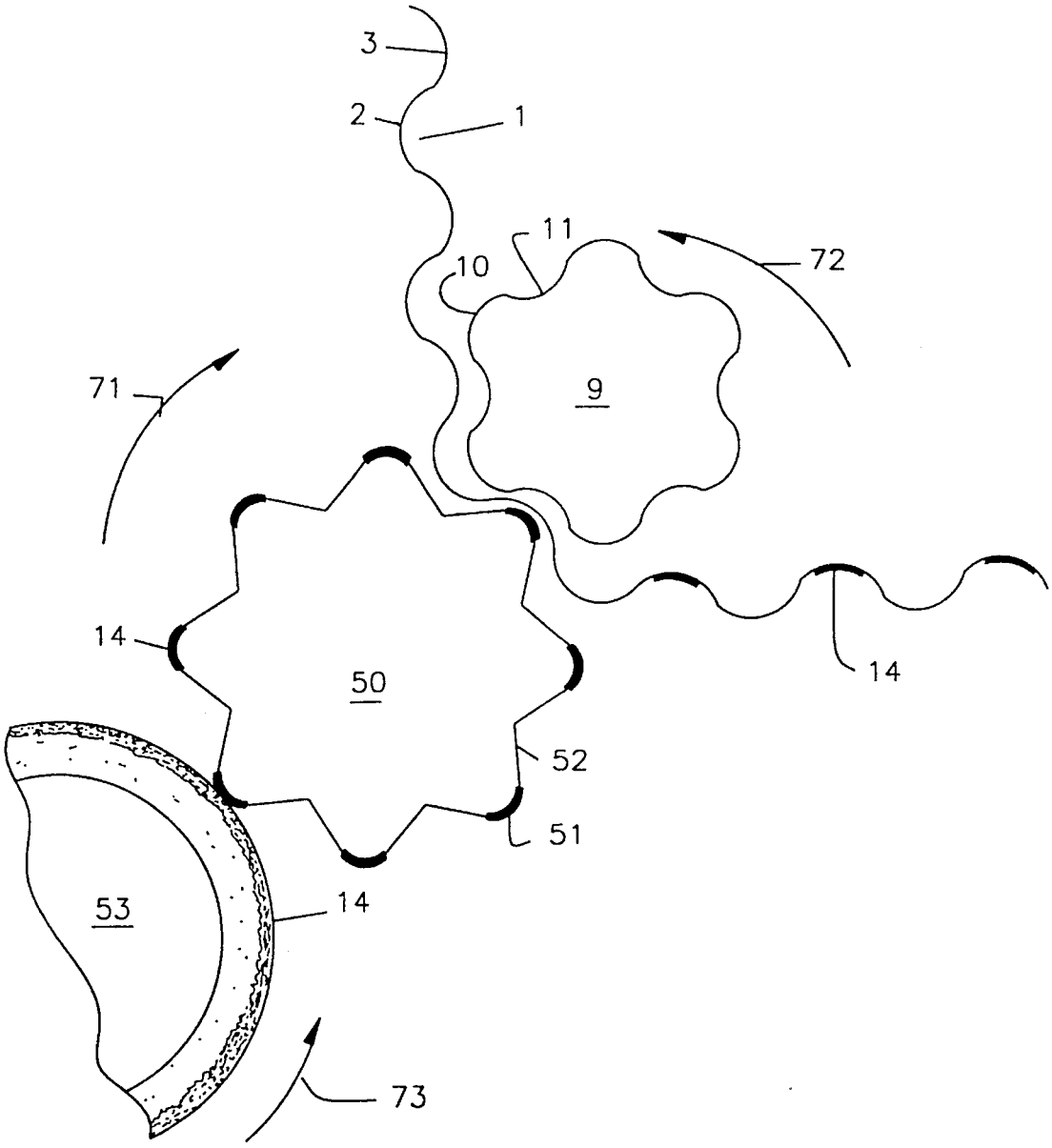
FIG. 9 shows an apparatus constructed in accordance with the invention for applying material to the troughs of corrugated sheet material.

FIG. 9 shows an apparatus constructed in accordance with the invention for applying material to the troughs 3 of corrugated sheet material 1. FIG. 9 shows a corrugated sheet material 1 defining sheet material crests 2 and sheet material troughs 3. First roller 50 is provided with a plurality of circumferentially-undulating flutes disposed about it peripheral surface defining first roller crests 51 and first roller troughs 52. Second roller 9 is provided with a plurality of circumferentially-undulating flutes disposed about its peripheral surface defining second roller crests 10 and second roller troughs 11. The first roller 50 and second roller 9 are aligned so that as the rollers rotate in the direction shown by the arrows 71 and 72 the crests 10 and 51 of one roller nest in the troughs 11 and 52 of the other roller. At the stage of rotation shown in FIG. 9, first roller crest 51 nests in second roller trough 11. Sufficient space is provided between the first roller 50 and the second roller 9 so that the corrugated sheet material 1 is gripped and can pass between the first and second rollers 50 and 9.

It will be understood by those skilled in the art that the concentration and viscosity of the material to be applied may be varied as specific circumstances and applications dictate to control film thickness. Regulating the volume of coating material fed to the pressurized nozzles will also control film thickness. Increasing the dwell time of the spray from the pressure nozzle will also increase the coating thickness. The control of spray applications can also be controlled by electrostatic deposition. If the roll application method coatings (shown in FIGS. 9 and 10) is utilized, the roll pressure can be increased to reduce the thickness of the coating. Other methods of regulating the thickness of the coating are to electrostatically charge the coating material and the material to be coated and to regulate the percentage of solids in liquid coatings.

As shown in FIG. 9, the crests 51 of the first roller 50 are used as a casting surface. The external surface of the crests 51 of the first roller 50 are first wetted with the material 14 to be applied to the troughs 3 of the corrugated sheet material 1. The wetting is conveniently accomplished using a transfer roll technique wherein a pickup drum 53 rotating partially in a bath is in contact with the crests 51 of the first roller 50. As the pick-up drum 53 rotates in a direction shown by arrow 73, the material 14 to be applied to the troughs 3 of the corrugated sheet material 1 adheres to the external surface of the pick-up drum 53. As the pick-up drum 53 and first roller 50 rotate) as shown by arrows 71 and 73 in FIG. 9, the material 14 is transferred from the external surface of the pick-up drum 53 and is applied to the external surface of the crests 51 of the first roller 50. The corrugated sheet material 1 is passed between the first roller 50 and the second roller 9 and as the crests 51 of the first roller 50 contact the troughs 3 of the sheet material 1 the material 14 to be deposited is applied to the troughs 3.

Figure 10:
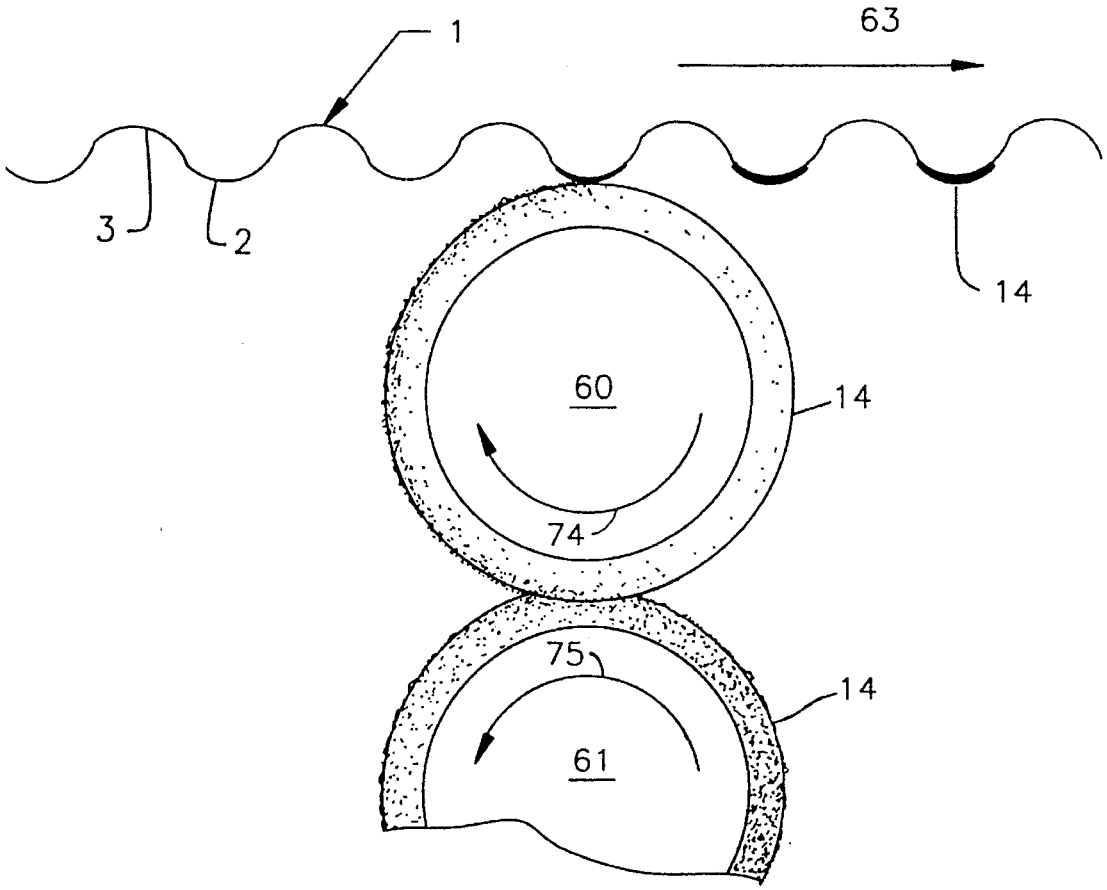
FIG. 10 shows an apparatus constructed in accordance with the invention for applying material to the crests of corrugated sheet material.

FIG. 10 shows an alternative embodiment of the invention for applying material to the crests of corrugated sheet material. As shown in FIG. 10, a large rotatably driven smooth-surfaced application drum 60 is used as a casting surface. The surface of the application drum 60 is first wetted with the material 14 to be applied to the crests 2 of the corrugated sheet material 1. The wetting is conveniently accomplished using a transfer roll technique wherein a pickup drum 61 rotating partially in a bath is in contact with the drum 60. As the pick-up drum 61 rotates, the material 14 to be applied to the crests 2 adheres to the external surface of the pick-up drum 61. As the pick-up drum 61 and drum 60 rotate, as shown by arrows 74 and 75 in FIG. 10, the material 14 is transferred from the external surface of the pick-up drum 61 and is applied to the external surface of the application drum 60. The corrugated sheet material 1 is passed over the application drum as shown by arrow 63 and as the crests 2 come in contact with the external surface of drum 60 the material 14 is applied to the crests 2.

In an alternative embodiment of the invention, the previously described embodiments of the apparatus and methods are used to apply a masking material to areas in which the coating material is not to be applied. After the masking material has been applied, the material to be coated is either sprayed or submerged in a bath so that the material to be applied adheres to the unmasked areas. The material used for masking may be selected so that it repels the coating material to be applied to the unmasked areas. Alternatively, the masking material may be selected so that it, and any coating material which may have adhered to it, washes away easily after the coating material has been applied to the unmasked areas.

In some applications, e.g. catalytic converters, it may be desirable to stipple the surface to be treated or increase the treated surface area in some other way. Most catalytic oxidation systems in the U.S. use a catalyst supported on a monolithic cordierite-based ceramic, coated with a high surface area washcoat. The washcoat often contains aluminum oxides to increase the catalyst surface area by about 10 times, plus rare earth compounds to act as catalyst promoters and to enhance thermal stability. Binders in the washcoat bind the coating to the ceramic substrate. Fine particles of platinum, palladium and sometimes rhodium may be uniformly distributed on the surface of the washcoat. When VOC-laden fumes and oxygen molecules contact these sites they are catalytically converted into carbon dioxide and water vapor. Increasing the surface area increases the number of reactions sites and, thus, the efficiency.

It will be understood by those skilled in the art that a substantially flat sheet may also be treated utilizing the apparatus and method of the invention. If necessary, the substantially flat sheet may be registration formed after treatment to impart the desired shape.

The foregoing discussion discloses and discuses merely exemplary embodiments of the present invention. One skilled in the art will readily recognize from such discussion that various changes, modifications, and variations may be made therein without departing from the spirit and scope of the invention as defined in the following claims.

I claim:

1. An apparatus for selectively applying a coating material to sheet material, comprising:

a. a first roller provided with a plurality of circumferentially undulating flutes disposed about its peripheral surface defining crests and troughs, said first roller provided with a longitudinal bore and a longitudinal aperture communicating with said longitudinal bore;

b. a second roller provided with a plurality of circumferentially undulating flutes disposed about its peripheral surface defining crests and troughs; said first roller and said second roller disposed for synchronized rotation with each other so that the crests of one roller rest in the troughs of the other roller; and c. spray means disposed within said first roller, said spray means synchronized with said first roller aperture to discharge a coating material through said aperture when said spray means and said aperture are in alignment.

* * * * *